US007073519B2

(12) United States Patent
Choi et al.

(10) Patent No.: US 7,073,519 B2
(45) Date of Patent: Jul. 11, 2006

(54) FACILITY PARTS CLEANING SOLUTION FOR PROCESSING OF (METH)ACRYLIC ACID AND/OR (METH)ACRYLIC ESTERS AND CLEANING METHOD USING SAID CLEANING SOLUTION

(75) Inventors: Seok-Hwan Choi, Daejeon (KR); Seong-Pil Kang, Daejeon (KR); Kyoung-Su Ha, Daejeon (KR); Geon-Yong Kim, Seoul (KR); Boo-Gon Woo, Daejeon (KR)

(73) Assignee: LG Chem, Ltd., Seoul (KR)

( * ) Notice: Subject to any disclaimer, the term of this patent is extended or adjusted under 35 U.S.C. 154(b) by 0 days.

(21) Appl. No.: 11/131,264

(22) Filed: May 18, 2005

(65) Prior Publication Data

US 2005/0277571 A1 Dec. 15, 2005

(30) Foreign Application Priority Data

May 18, 2004 (KR) ..... 10-2004-0035126

(51) Int. Cl.

| | |
|---|---|
| ***B08B 3/04*** | (2006.01) |
| ***B08B 9/027*** | (2006.01) |
| ***C11D 7/06*** | (2006.01) |
| ***C11D 7/32*** | (2006.01) |

(52) U.S. Cl. ..... 134/22.13; 134/22.14; 134/22.18; 134/22.19; 134/28; 134/42; 510/188; 510/218; 510/219; 510/234; 510/253; 510/254; 510/499; 510/501

(58) Field of Classification Search ..... None
See application file for complete search history.

(56) References Cited

U.S. PATENT DOCUMENTS

| | | | | |
|---|---|---|---|---|
| 3,926,830 | A * | 12/1975 | Horiguchi et al. | 510/100 |
| 4,468,257 | A | 8/1984 | Kaneko et al. | |
| 4,559,159 | A * | 12/1985 | Denzinger et al. | 510/434 |
| 5,919,742 | A * | 7/1999 | Tsuzuki et al. | 510/112 |
| 6,699,830 | B1 * | 3/2004 | Matsuo et al. | 510/475 |
| 2002/0195126 | A1 | 12/2002 | Aichinger et al. | |

FOREIGN PATENT DOCUMENTS

| | | |
|---|---|---|
| EP | 1 033 359 A2 | 9/2000 |
| JP | 06-100893 | 4/1994 |

* cited by examiner

*Primary Examiner*—Gregory R. Del Cotto
(74) *Attorney, Agent, or Firm*—Birch, Stewart, Kolasch & Birch, LLP

(57) ABSTRACT

The present invention relates to a facility parts cleaning solution for the processing of (meth)acrylic acid and/or (meth)acrylic esters and a cleaning method using the cleaning solution. An aqueous cleaning composition comprising 5 to 50 wt % of at least one alkali metal hydroxide selected from the group consisting of sodium hydroxide and potassium hydroxide, 0.01 to 1 wt % of a water-soluble amino acid, 0.001 to 0.05 wt % of N,N'-methylene bisacrylamide, and 0.001 to 0.05 wt % of azobisisobutyronitrile is used to clean facility parts for manufacturing (meth)acrylic acid and/or (meth)acrylic esters in order to easily remove polymers and deposits.

5 Claims, 2 Drawing Sheets

FACILITY PARTS CLEANING SOLUTION FOR PROCESSING OF (METH)ACRYLIC ACID AND/OR (METH)ACRYLIC ESTERS AND CLEANING METHOD USING SAID CLEANING SOLUTION

CROSS REFERENCE TO RELATED APPLICATION

This application claims priority to and the benefit of Korea Patent Application No. 10-2004-0035126, filed on May 18, 2004, which is hereby incorporated by reference for all purposes as if fully set forth herein.

FIELD OF THE INVENTION

The present invention relates to a facility parts cleaning solution for the processing of (meth)acrylic acid and/or (meth)acrylic esters, and a cleaning method using the cleaning solution.

BACKGROUND OF THE INVENTION

'(Meth)acrylic acid' is the collective term including 'methacrylic acid' and 'acrylic acid'. In the present invention, the term '(meth)acrylic acid' is used with the above meaning.

Generally, (meth)acrylic acid esters are prepared by esterification of alkanols and (meth)acrylic acid in the presence of strong acids.

In general, synthesis of (meth)acrylic acid is performed in facilities comprising distillation columns, extractors, and mixers. In the process, heat exchange is primarily carried out with a plate type or tube-bundle type of spiral heat exchanger, or a rotary evaporator.

The problem of preparing (meth)acrylic acid and (meth) acrylic acid esters by the conventional method is that unwanted radical polymerization is caused by light or heat. In particular, in esterification, control of temperature for avoiding the unwanted radical polymerization and obtaining desired esterification rate is complicated. Because this problem also occurs in purification of (meth)acrylic acid or (meth)acrylic acid esters, a high-temperature boiler involved in the process should be separated from a low-temperature boiler and separation of esters should be done within an appropriate temperature range.

If not, it is highly plausible that unwanted polymerization of (meth)acrylic acid and (meth)acrylic acid esters takes place. Indeed, resultant polymers are deposited and cause contamination in facility parts including pipes, pumps, evaporators, distillation columns, heat exchangers, and condensers.

Polymerization inhibitors may be added when mixing reactants in order to prevent such unwanted polymerizations, but empirically and theoretically, it is impossible to prevent all polymerization from occurring inside the reactor. Thus, most manufacturing processes of (meth)acrylic acid or (meth)acrylic acid esters thus far have operated the reaction apparatus for weeks or tens of weeks, and the operation has then been stopped to clean off unwanted polymers and then re-operate the apparatus.

Also, highly viscous and high molecular weight polymer compounds resulting from the Michael reaction of (meth) acrylic acid and (meth)acrylate, which deposit at processing apparatuses, pose another problem. These polymer compounds have previously been removed manually or by using adequate solvents, which is not only ineffective and costly but also causes environmental pollution.

Generally, organic solvents such as dimethylformamide, dibutylformamide, dimethylacetamide, sulfolane, N-methylpyrrolidone, etc., have been used to clean processing apparatuses. However, as with manual cleaning, the polymers are not completely removed by this method, thereby reducing productivity and causing production efficiency losses.

In circulation cleaning using the conventional cleaning solutions, incomplete cleaning of polymer compounds may result in frequent side reactions during re-operation and their shortened occurring periods, in spite of using alkali metal hydroxide solutions and drying processes.

Accordingly, an improved cleaning solution for facility parts and a cleaning method capable of overcoming the problems of the conventional cleaning materials, methods, and procedures with regard to preparation of (meth)acrylic acid and/or (meth)acrylic esters are urgently needed.

SUMMARY OF THE INVENTION

It is an aspect of the present invention to provide a facility parts cleaning composition for the processing of (meth) acrylic acid and/or (meth)acrylic esters comprising an alkali metal hydroxide solution, a water-soluble amino acid, N,N'-methylene bisacrylamide, and azobisisobutyronitrile, and a cleaning method using the cleaning solution composition.

To attain the aspect, the present invention provides an aqueous cleaning composition including 5 to 50 wt % of at least one alkali metal hydroxide selected from the group consisting of sodium hydroxide and potassium hydroxide, 0.01 to 1 wt % of a water-soluble amino acid, 0.001 to 0.05 wt % of N,N'-methylene bisacrylamide, and 0.001 to 0.05 wt % of azobisisobutyronitrile.

The invention also provides a cleaning method of facility parts for processing (meth)acrylic acid and/or (meth)acrylic esters, which includes the steps of:

(a) removing (meth)acrylic acid and/or (meth)acrylic esters which have been produced in the manufacturing process, from facility parts;

(b) washing the facility parts with water and then cleaning them again with the cleaning solution composition; and (c) washing the facility parts with water more than once and removing the cleaning composition from the facility parts.

BRIEF DESCRIPTION OF THE DRAWINGS

The accompanying drawings, which are included to provide further understanding of the invention, constitute a part of this specification and illustrate an embodiment of the invention and, together with the description, serve to explain the principles of the invention.

DETAILED DESCRIPTION OF THE PREFERRED EMBODIMENTS

Figure 1:
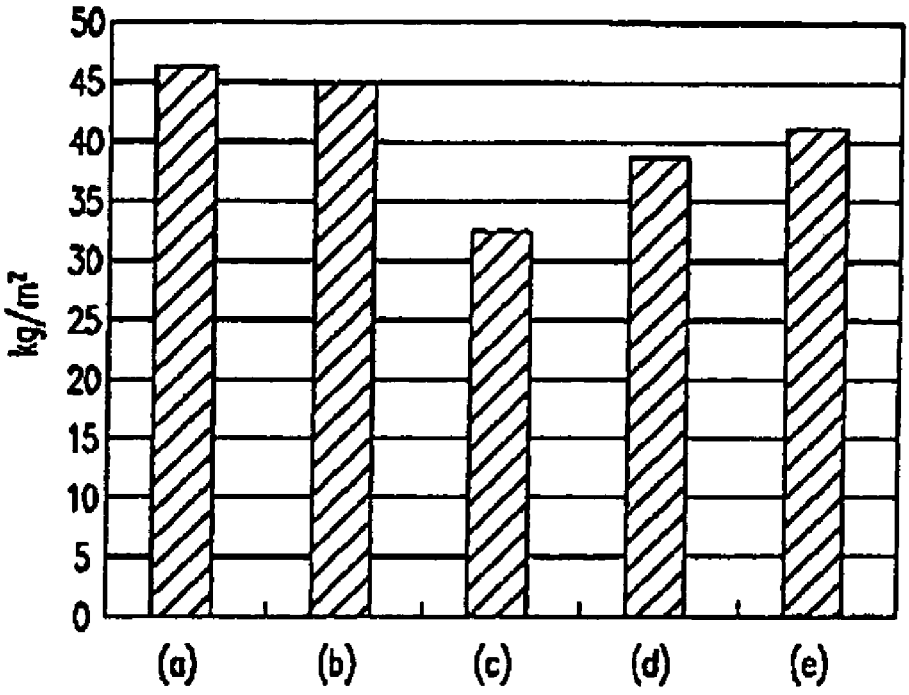
FIG. 1 compares the amount of polymers deposited in distillation towers wherein the cleaning solution compositions of Examples 1 to 3 and Comparative Example 1 were used.

The present inventors developed a cleaning composition capable of preventing solidification and deposition of polymer materials during the manufacturing process of (meth) acrylic acid and/or (meth)acrylic esters by adding a suitable concentration of amino acid along with alkali metal hydroxides, given that (meth)acrylic acid and/or (meth)acrylic esters participate in Michael polymerization along with amino acid and that oligomers or dimers not removed during washing grow into polymers during re-operation.

Hereunder is given a detailed description of the present invention.

Preferably, the cleaning composition of the present invention is an aqueous solution comprising 5 to 50 wt % of at least one alkali metal hydroxide selected from the group consisting of sodium hydroxide and potassium hydroxide, 0.01 to 1 wt % of a water-soluble amino acid, 0.001 to 0.05 wt % of N,N'-methylene bisacrylamide, and 0.001 to 0.05 wt % of azobisisobutyronitrile.

If the content of the alkali metal hydroxide is below 5 wt %, the cleaning effect is slight. Otherwise, if it exceeds 50 wt %, steam heating may become difficult because the boiling point (b.p.) of the cleaning composition rises. If the content of the water-soluble amino acid is below 0.01 wt % or if that of N,N'-methylene bisacrylamide is below 0.001 wt % or if that of azobisisobutyronitrile is below 0.001 wt %, the effect of adding them is slight. Otherwise, if the content of the water-soluble amino acid exceeds 1 wt % or if that of N,N'-methylene bisacrylamide exceeds 0.05 wt % or if that of azobisisobutyronitrile exceeds0.05 wt %, the improvement in cleaning effect is small with respect to the addition amount, thereby resulting in cost ineffectiveness. The amino acid in the cleaning composition may be glycine, alanine, valine, leucine, isoleucine, threonine, serine, cysteine, cystine, methionine, aspartic acid, asparagine, glutamic acid, diiodotyrosine, lysine, arginine, histidine, tyrosine, tryptophan, proline, oxyproline, β-alanine, aminobutyric acid, ornithine, citrulline, homoserine, triiodotyrosine, thyroxine, dioxyphenylalanine, or a mixture thereof.

The temperature of the cleaning composition during the cleaning process is preferably 10 to 150° C., more preferably 60 to 100° C.

The facility parts to be cleaned are all parts constituting or connecting each facility unit, the methods used including reactors, distillation columns, extractors, heat exchangers, evaporators, condensers, tubes, and pumps. More specifically, the facility parts to be cleaned are the parts where reactants or esterificabon products, particularly products from reaction of (meth)acrylic acid and alkanols, are deposited, for example, the parts constituting or connecting each facility unit, including reactors, distillation towers, extractors, heat exchangers, evaporators, condensers, tube bundles, and pumps.

In particular, the distillation unit located between the top of the distillation tower and the evaporator is a facility part to be cleaned. This is because the alkali metal hydroxide of the cleaning composition hydrolyzes the ester functional groups of the (meth)acrylate polymers and separates them into alkanol materials. Through this chemical process, unwanted polymer compounds are removed from the facility parts.

In order to remove polymer compounds from the distillation unit using an alkali metal hydroxide solution, the cleaning tube should be heated adequately, so that the cleaning composition is transferred easily from inside of the evaporator to the top of the distillation tower. The cleaning tube aids the trays at the top or inside of the distillation tower to be cleaned by the cleaning solution composition.

The polymer compounds separated and removed from the facility parts are decomposed and separated again during the cleaning process by phase separation, distillation, or stripping. The highly water-soluble alkanols are separated from the cleaning composition by distillation or stripping using air or steam, and less water-soluble alkanols are separated by the second phase separation. The alkanols contained in the waste water may be recycled by stripping. The cleaning composition may be used several times by recycling. However, the reuse should be discontinued if the concentration of the alkali metal hydroxide decreases to less than 5%.

The polymer compounds, which are byproducts generated during manufacturing of (meth)acrylic acid or (meth)acrylic acid esters, are amphoteric polymers derived from zwitterions. Thus, if the (meth)acrylic acid or (meth)acrylic acid ester contanins an amino acid group, acid hydrolysis takes place.

Because these polymer compounds produced inside the reaction towers have a complicated structure of numerous anions and cations, contraction and swelling are reiterated if they are passed through a cleaning composition comprising an alkali metal hydroxide or pure water. If amino acids are present in the cleaning solution composition, remaining polymer seeds are rapidly united with polymer compounds because of the unique amphiphilic functional groups of the amino acids, thereby preventing side reactions during re-operation.

The cleaning process according to the present invention is as follows.

The cleaning process of facility parts for the manufacture of (meth)acrylic acid and/or (meth)acrylic esters according to the present invention comprises the steps of:

(a) removing (meth)acrylic acid and/or (meth)acrylic esters, which have been produced in the manufacturing process, from facility parts;

(b) washing the facility parts with water and then cleaning them again with the cleaning solution composition; and (c) washing the facility parts with water more than once and removing the cleaning composition from the facility parts.

In the manufacturing process of (meth)acrylic acid or (meth)acrylic acid esters, the re-boiler of a distillation tower, which is the essential part, the body of the distillation tower itself, and the heat exchanger, which is easily blocked by byproduct polymers, and other parts are usually cleaned by draining of process liquid, water washing, steam distillation, alkaline steam distillation, etc. Without regard to the kind of cleaning composition used, the liquid level of the reflux vessel should be lowered before switching. The parts not to be cleaned should be disconnected in advance. Cleaning is performed after draining units and connecting parts of the process liquid. Columns are cleaned by steam distillation or alkaline steam distillation depending on the degree of contamination. Tanks and vessels are usually washed with water, but if severely contaminated, they can be cleaned by steam boiling or alkaline steam boiling. In case of water washing, the cleaning solution is fed into the pump suction joined to the operating unit and the conveying lines are cleaned using the pump. The waste water is discarded via a column or tank or directly to the waste water vessel.

The conventional cleaning method by steam or alkaline steam distillation using the conventional alkaline cleaning composition is as follows. First, after completing draining of cleaning composition and water washing, all connected lines are washed. Then, all liquids contained in the process liquid line, alkaline solution line, and waste line are removed. To be specific, the process liquid is filled at the tower and steam is supplied to the heater at the bottom of the tower or directly injected. Next, the process liquid is transferred to the feed line or reflux line and the distillation tower (column) is set to the steam distillation status. Then, the liquid at the bottom of the tower is withdrawn to the waste vessel keeping the liquid level normally. In this process, the process liquid is usually exchanged with 4% (by weight) sodium hydroxide solution and the distillation rate is reduced.

The present invention improves cleaning performance by adding to the 4% alkaline solution, particularly an alkaline solution containing sodium hydroxide or potassium hydroxide, a water-soluble amino acid, N,N'-methylene bisacrylamide, and azobisisobutyronitrile.

After preheating 3 to 5 hours, as described above, using the cleaning solution composition, the liquid at the bottom of the tower is discarded to the waste vessel during the operation for cleaning. At the same time, the process liquid is supplied via the feed line or reflux line. Cleaning is continued until the pH of the liquid at the bottom of the tower falls below 9. When the pH of the liquid at the bottom of the tower and the distillate falls below 9, the column is washed again with the process liquid and then cooled. Finally, all feed lines and columns are drained.

Conventionally, the waste heat boiler, which is used for manufacturing (meth)acrylic acid or (meth)acrylic acid esters, has been cleaned by removing it using a slip plate from other equipment, filling 4% (by weight) alkaline solution in the tube side, and circulating the solution by supplying steam to the shell side. The temperature of the circulating cleaning composition is maintained at 70 to 80° C.

In the present invention, the cleaning performance of the cleaning composition is improved by adding additives to the conventional alkaline solution, particularly an aqueous alkaline cleaning composition containing sodium hydroxide or potassium hydroxide, a water-soluble amino acid, N,N'-methylene bisacrylamide, and azobisisobutyronitrile. Generally, cleaning is completed 15 to 20 hours after the steam supply. In general, byproducts remain after the cleaning is completed. Such remaining solids are usually removed by a motor-driven brush. The cleaning composition of the present invention has been confirmed to leave such materials in a much lower amount.

Hereinafter, the present invention is described further in detail with reference to examples. However, the following examples are only for the understanding of the present invention and the present invention is not limited to or by them.

EXAMPLE 1

5 wt % sodium hydroxide, 0.1 wt % L-lysine, 0.001 wt % N,N'-methylene bisacrylamide (MBAA), and0.001 wt % azobisisobutyronitrile (AIBN) were added to water, so that the total content became 100 wt %. The mixture was stirred and dissolved to prepare the cleaning composition of the present invention.

Facility parts used for manufacturing (meth)acrylic acid or (meth)acrylic acid esters were steam cleaned for 2 hours using the cleaning solution composition, while maintaining the temperature of the composition at 85° C. Then, a distillation tower test was preformed.

EXAMPLE 2

A cleaning composition was prepared in the same manner of Example 1 except for adding 0.1 wt % glycine instead of L-lysine. Facility parts were cleaned in the same manner of Example 1. Then, a distillation tower test was preformed.

EXAMPLE 3

A cleaning composition was prepared in the same manner of Example 1 except for adding 0.1 wt % β-alanine instead of L-lysine. Facility parts were cleaned in the same manner of Example 1. Then, a distillation tower test was preformed.

Comparative Example 1

The procedure of Example 1 was followed, except for using an aqueous solution comprising 5 wt % sodium hydroxide as a cleaning solution composition. Facility parts were cleaned in the same manner of Example 1. Then, a distillation tower test was preformed.

The distillation tower test showed that when the distillation tower was cleaned with the cleaning composition of Comparative Example 1 and then operated for 6 months, there were a lot of deposited polymers generated by side reaction. In comparison, when the distillation tower was cleaned with the cleaning composition of the present invention (Examples 1 to 3) and then operated for 6 months, the amount of deposited polymers was reduced significantly.

Similarly, for the cleaning of other facility parts for manufacturing (meth)acrylic acid or (meth)acrylic acid esters, the cleaning composition of the present invention significantly reduced deposited polymers at the narrow sites, which are difficult to clean. In addition, the remaining deposits, if any, were easy to remove, because of increased swelling.

Testing Example 1

Comparison of Cleaning Effect—Comparison of Amount of Deposited Polymers

In order to compare the cleaning effect of the cleaning composition of the present invention with that of the conventional cleaning solution composition, distillation towers were cleaned with the cleaning solution compositions of Comparative Example 1 and Examples 1 to 3 and operated for 6 months. The amounts of polymers deposited at the feeding column of the water separation tower, which is notorious for polymer deposition, were compared. The results are shown in FIG. 1.

In FIG. 1, (a) is the amount of the polymer deposited at the inner wall of the feeding column of the 205 distillation tower, which was present before operation, (b) is the amount of the polymer deposited at the inner wall of the feeding column of the 205 distillation tower 6 months after being cleaned with the cleaning composition of Comparative Example 1, (c) is the amount of the polymer deposited at the inner wall of the feeding column of the 205 distillation tower 6 months after being cleaned with the cleaning composition of Example 1, (d) is the amount of the polymer deposited at the inner wall of the feeding column of the 205 distillation tower 6 months after being cleaned with the cleaning composition of Example 2, and (e) is the amount of the polymer deposited at the inner wall of the feeding column of the 205 distillation tower 6 months after being cleaned with the cleaning composition of Example 3.

As seen in the figure, when cleaned with the conventional cleaning solution composition, the amount of deposited polymer was almost the same as before 6 months. However, when cleaned with the cleaning composition of the present invention, the amount of deposited polymer was significantly smaller.

Testing Example 2

Comparison of Cleaning Effect—Comparison of Viscosity of Deposited Polymers

In order to compare the cleaning effect of the cleaning composition of the present invention with that of the conventional cleaning solution composition, distillation towers were cleaned with the cleaning solution compositions of Comparative Example 1 and Examples 1 to 3 and operated for 6 months. Viscosities of polymers deposited at the feeding column of the water separation tower was compared. The results are shown in FIG. 2.

Figure 2:
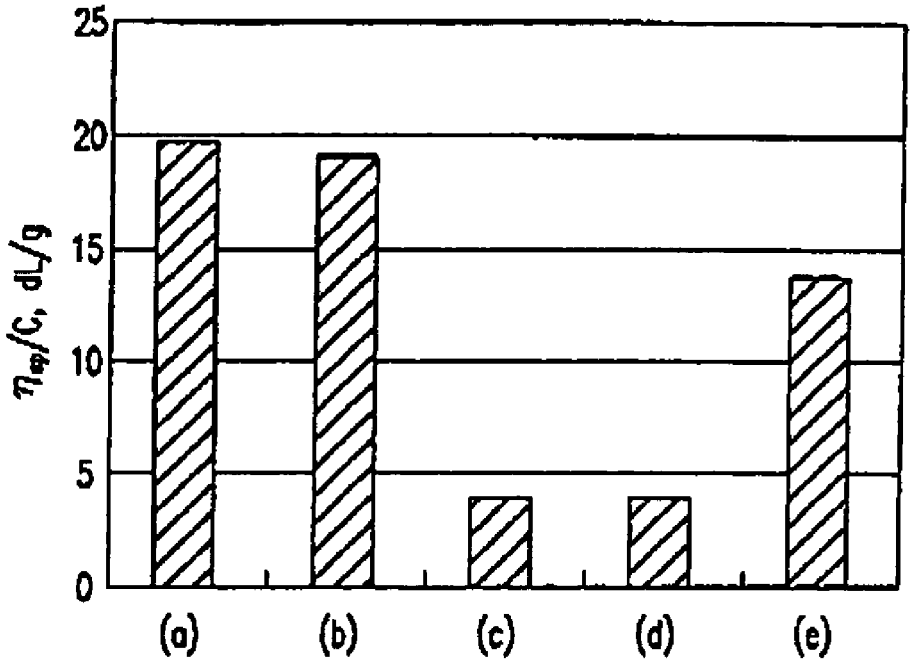
FIG. 2 compares the viscosity of polymers deposited in distillation towers wherein the cleaning solution compositions of Examples 1 to 3 and Comparative Example 1 were used.

In FIG. 2, (a) to (e) are the same as in Testing Example 1.

As seen in the figure, when cleaned with the cleaning composition of Comparative Example 1, the viscosity of deposited polymer was almost the same as before 6 months. However, when cleaned with the cleaning composition of the present invention (Examples 1 to 3), the viscosity of deposited polymer was much lower.

Because the cleaning composition of the present invention removes polymer seeds, which could not be removed with the conventional cleaning solution compositions, polymer deposition can be prevented in advance.

The cleaning composition of the present invention reduces viscosity of polymers found in the reaction tower or facility parts connected with it. As the viscosity of the polymers decreases, polymer seeds remaining at the part of the reaction tower or other facility parts, which is not easy to clean, are rapidly transformed into polymer compounds and washed off by the cleaning solution composition. Also, as the viscosity of the deposited polymers decreases, they are swollen and easily washed off by the cleaning composition by chemical or mechanical process. As a result, polymers and deposits can be easily removed from facility parts.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. An aqueous cleaning composition comprising 5 to 50 wt % of at least one alkali metal hydroxide selected from the group consisting of sodium hydroxide and potassium hydroxide, 0.01 to 1 wt % of a water-soluble amino acid, 0.001 to 0.05 wt % of N,N'-methylene bisacrylamide, and 0.001 to 0.05 wt % of azobisisobutyronitrile.

2. A cleaning method of facility parts for processing (meth)acrylic acid and/or (meth)acrylic esters, which comprises the steps of:

(a) removing (meth)acrylic acid and/or (meth)acrylic esters, which have been produced in the manufacturing process, from facility parts;

(b) washing the facility parts with water and then cleaning them again with a cleaning composition comprising 5 to 50 wt % of at least one alkali metal hydroxide selected from the group consisting of sodium hydroxide and potassium hydroxide, 0.01 to 1 wt % of a water-soluble amino acid, 0.001 to 0.05 wt % of N,N'-methylene bisacrylamide, and 0.001 to 0.05 wt % of azobisisobutyronitrile; and (c) washing the facility parts with water more than once and removing the cleaning composition from the facility parts.

3. The cleaning method of claim 2, wherein the amino acid is selected from the group consisting of glycine, alanine, valine, leucine, isoleucine, threonine, serine, cysteine, cystine, methionine, aspartic acid, asparagine, glutamic acid, diiodotyrosine, lysine, arginine, histidine, tyrosine, tryptophan, proline, oxyproline, β-alanine, aminobutyric acid, ornithine, citrulline, homoserine, triiodotyrosine, thyroxine, dioxyphenylalanine, and a mixture thereof.

4. The cleaning method of claim 2, wherein the temperature of the cleaning composition is 10 to 150° C.

5. The cleaning method of claim 2, wherein the facility parts are reactors, distillation columns, extractors, heat exchangers, evaporators, condensers, tubes, or pumps.

* * * * *